United States Patent [19]

Ehrenskjold et al.

[11] 4,095,919

[45] Jun. 20, 1978

[54] FOLDABLE PROPELLERS

[75] Inventors: Nils Oluf Ehrenskjold, Kolding; Torben Munk, Virum, both of Denmark

[73] Assignee: Gorivaerk AS, Kolding, Denmark

[21] Appl. No.: 705,896

[22] Filed: Jul. 16, 1976

Related U.S. Application Data

[63] Continuation-in-part of Ser. No. 487,220, Jul. 10, 1974, Pat. No. 3,981,613.

[30] Foreign Application Priority Data

Jul. 11, 1973 United Kingdom ..... 33044/73
Oct. 23, 1973 United Kingdom ..... 49219/73

[51] Int. Cl.[2] ..... B63H 1/24
[52] U.S. Cl. ..... 416/142; 416/140
[58] Field of Search ..... 416/142, 140, 143

[56] References Cited

U.S. PATENT DOCUMENTS

| | | | |
|---|---|---|---|
| 1,491,997 | 4/1924 | Messick | 416/131 |
| 1,682,893 | 9/1928 | Cierva | 416/140 A X |
| 1,862,481 | 6/1932 | Glenwright | 416/140 |
| 2,493,869 | 1/1950 | Hafner | 416/140 A X |
| 2,500,382 | 3/1950 | Rowley | 416/142 |
| 3,223,389 | 12/1965 | Simmonds | 416/142 X |
| 3,981,613 | 9/1976 | Ehrenskjold et al. | 416/142 |

FOREIGN PATENT DOCUMENTS

| | | | |
|---|---|---|---|
| 768,964 | 8/1934 | France | 416/142 |
| 21,920 of | 1911 | United Kingdom | 416/142 |
| 1,268,577 | 3/1972 | United Kingdom | 416/142 |

*Primary Examiner*—Everette A. Powell, Jr.
*Attorney, Agent, or Firm*—Fleit & Jacobson

[57] ABSTRACT

A fluid pump including a shaft arranged to be rotatably driven by a motor of the like which includes one or more blades pivotally mounted at their inner ends on the shaft so as to be freely pivotal during the rotation of the shaft into an equilibrium angular position throughout an angular range extending in both directions from a 90° position and in an axial plane with respect to the axis of the shaft.

8 Claims, 9 Drawing Figures

FOLDABLE PROPELLERS

This application is a continuation-in-part of the application entitled Foldable Propellers, Ser. No. 487,220 filed by the applicants herein on July 10, 1974 now U.S. Pat. No. 3,981,613.

BACKGROUND OF THE INVENTION

In a typical pump for pumping a fluid such as water, oil or the like and, in particular, an axial flow pump, a plurality of blades or impellors are arranged on a shaft in circumferentially spaced relationship so that rotation of the blades by the shaft produce a pumping action on the fluid, the pitch of the blades determining the output of the pump. Such blades are generally securely mounted on the shaft and perform a fluid pumping operation regardless of the viscosity of the pumped fluid or the resistance to fluid flow in the pipe line in which the pump is installed. Thus, although the blades may be designed for maximum efficiency under certain average conditions, when unusual conditions develop such as a change in fluid viscosity or when a change in fluid flow resistance or the like, the efficiency of the pump becomes somewhat less than that desired increasing the comsumption of power and the wear and tear on the pump. Furthermore, it is not unusual for the pump driving motor to stop suddenly due to a power interruption or the like during a pumping operation with the attendant application of detrimental forces on the blades or on accessories such as pipelines associated with the propeller.

SUMMARY OF THE INVENTION

Accordingly, a primary object of this invention is to provide apparatus for pumping a fluid such as air, water, oil or the like in a highly efficient manner.

Another object of this invention is to provide a new and novel fan for blowing air such as a ventilator fan.

A further object of this invention is to provide a new and novel apparatus for pumping a fluid such as water or oil through a pipe line of relatively long length.

Still another object of this invention is to provide a new and novel apparatus for pumping a fluid in a pipe line or the like in which the efficiency of the pump motor is virtually independent of any variation in the viscosity of the pumped fluid.

A still further object of this invention is to provide a new and novel apparatus for pumping a fluid through a pipeline which automatically adjusts to the variations in fluid resistance in the pipe line and which virtually eliminates any damage to the blades due to the forces exerted by the fluid on the blades.

The objects of this invention and related objects are accomplished by the provision of a shaft on which one or more blades are pivotally mounted by suitable means at their inner ends for pumping engagement with the fluid to be pumped as the shaft is rotated by suitable drive means attached thereto. The blades are mounted on the shaft for freely pivotal movement during the pumping operation throughout an angular range extending in both direction from a 90° position and in an axial plane with respect to the axis of the shaft into an equilibrium angular position wherein the centrifugal and hydrodynamic forces exerted on the blades are balanced.

These and other objects of the invention as well as many of the attendant advantages thereof will become more readily apparent when reference is made to the following description taken in conjunction with the accompanying drawings.

BRIEF DESCRIPTION OF THE DRAWINGS

Referring now to FIGS. 1,2 there is shown a portion of the pumping apparatus of the invention which includes a shaft 11 arranged to be driven by suitable means such an electric motor 12. Shaft 11 may comprise the shaft of the motor 12 or may be a separate shaft connected to the shaft of motor 12 by a suitable coupling or the like.

Figure 1:
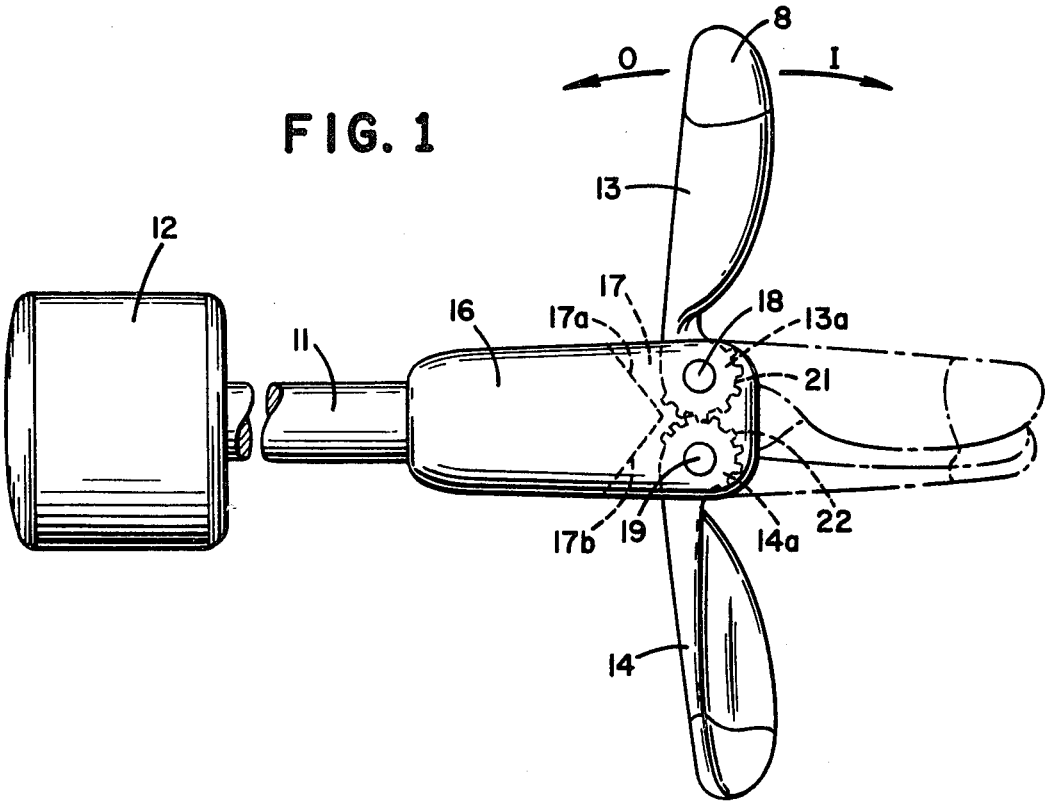
FIG. 1 is a side elevation view of a portion of the pumping apparatus of the invention.

In the preferred embodiment, at least one pair of blades 13, 14 are pivotally mounted at their inner ends on the shaft 11 for freely pivotal movement throughout an angular range extending in both directions from the 90° position of FIG. 1 and in an axial plane with respect to the axis of the shaft 11 as indicated by the arrows I and O respectively. In the illustrated embodiment, the means for pivotally mounting the blades 13, 14 on the shaft 11 preferably comprise a boss 16 having a groove or slot 17, the bottom wall of which is divided into two angularly disposed portions 17*a*, 17*b*. The inner ends of the blades 13, 14 are disposed within the slot 17 and are mounted for pivotal movement on pins 18, 19, inner ends 13*a*, 14*a* of the blades 13, 14 respectively being preferably provided with interengaging cog wheels or segments 21, 22 for simultaneous swinging of the blades together.

With the arrangement of FIG. 1, the blades 13, 14 are free to swing pivotally together in either direction as indicated by the arrows I, O. The movement of the blades in the direction of the arrow O is preferably limited by stop means which may be formed by the bottom wall portions 17*a*, 17*b* of the slot 17. In one embodiment, the blades 13, 14 are pivotally movable forwardly in the direction of the arrow O to a stop positon at an obtuse angle with respect to the axis of the shaft of approximately 110° to 130°. Similarly, the blades 13, 14 are free to move in the opposite direction as represented by arrow I into a folded position extending axially outward from the free end of the shaft 11 as represented by the broken lines in FIG. 1. It should be understood, that in one embodiment of the arrangement of the blades, as shown in FIG. 1 and as described and claimed in the aforementioned pending patent application, such a propeller arrangement is utilized as a boat propeller for driving a boat in both a forward and a rearward direction and the disclosure of this pending patent application is incorporated herein by reference.

Figure 2:
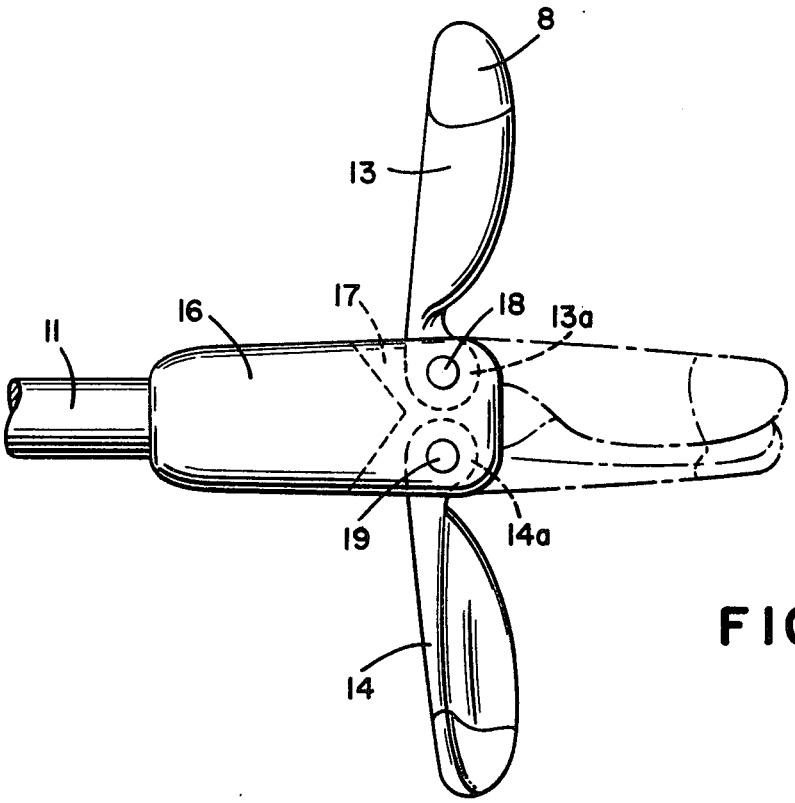
FIG. 2 is a view similar to FIG. 1 showing a modification of the pumping apparatus of the invention.

It should be understood, that the blades 13, 14 need not be arranged in interconnecting engagement by means of the gear wheel segment 21, 22. To this end, and as shown in FIG. 2, the inner ends 13*a*, 14*a* of the blades 13, 14 respectively are not in engagement so that each blade 13, 14 is free to pivot independently of the other. It should be understood, however, that this arrangement of the blades 13, 14 shown in FIG. 2 wherein each blade is free to pivot independently of the other, does not effect the novel results obtained with the construction of the invention as will be explained hereinafter.

Figure 3:
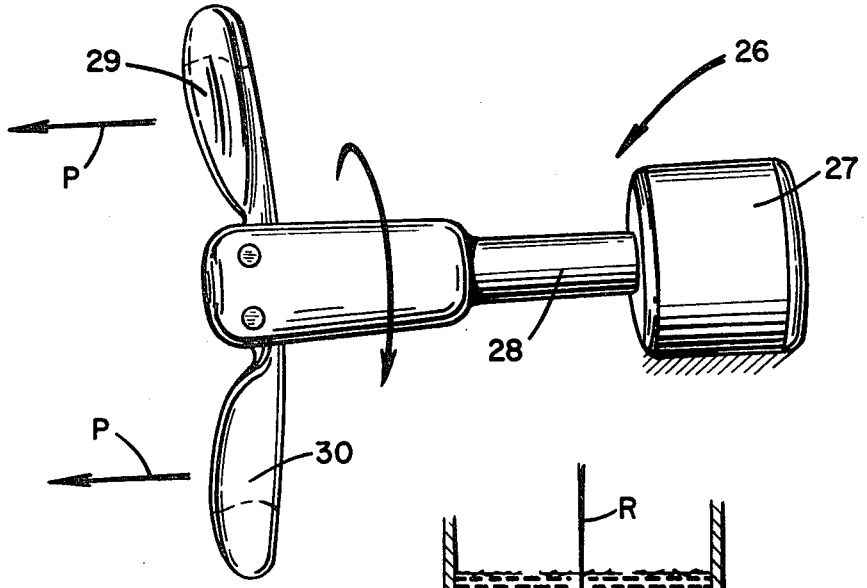
FIG. 3 is a side elevation view of a ventilator fan representing one embodiment of the invention.

As specifically illustrative of the invention, the arrangement of the invention as shown in FIGS. 1 and 2, part of forms pumping apparatus for pumping a fluid medium such as air, water, oil or the like and such a pumping structure may be embodied in a variety of embodiments. For instance, in FIG. 3, the pumping apparatus of the invention is in the form of a ventilator fan designated generally by the numeral 26 which includes a motor 27, a shaft 28 and a pair of blades 29, 30 mounted on the free end of the shaft 28 as discussed above with reference to FIGS. 1 and 2. When motor 27 has been energized and the shaft 28 rotated, the centrifugal forces exerted on the blades 29, 30 urge the blades into the solid line position of FIGS. 1, 2. However, the blades 29, 30 are also acted upon by the hydrodynamic forces of the medium in which the blades revolve which, in the embodiment of FIG. 3, is air so that the blades 29, 30 assume an equilibirum position with the centrifugal and hydrodynamic forces balanced to move the air in the direction of the arrows P. With this arrangement and as discussed in detail in the aforementioned pending patent application, not only is maximum efficiency obtained in a pumping apparatus such as the ventilator fan of FIG. 3 by the movement of the fan blades into an equilibrium angular position but any forces that might tend to oppose the pumping action of the blades with attendant destructive effects on the blades are compensated for as the blades automatically adjust to such extraneous forces.

It should also be understood that when the ventilator fan of FIG. 3 is deactivated, the blades will tend to assume the folded position as indicated by the broken lines in FIG. 1 provided, of course, that the blade arrangement includes the gear wheel segments 21, 22 of the embodiment of FIG. 1.

Figure 4:
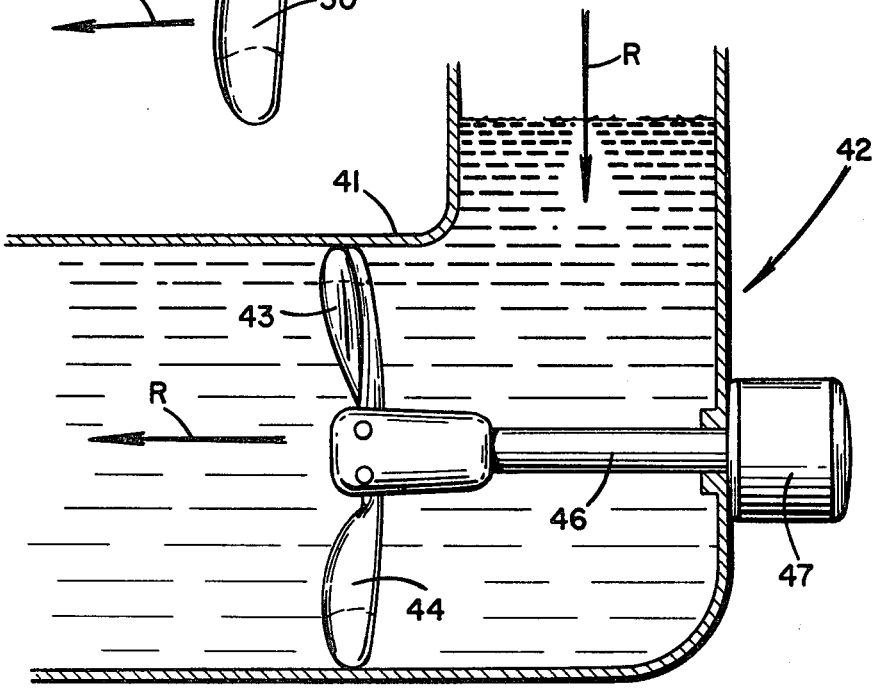
FIG. 4 is a side elevation view, partially in section, of a pump illustrating another embodiment of the invention.

FIG. 4 shows another embodiment of the invention wherein the medium to be pumped is a fluid such as water or oil flowing within a conduit or pipeline 41. In the pumping apparatus designated generally in FIG. 4 by the numeral 42, the blade arrangement corresponds to that of FIGS. 1 or FIG. 2 wherein blades 43, 44 are mounted on a shaft 46 and disposed within the interior of the pipeline 41. Drive means such as a motor 47 is disposed on the exterior of the pipeline 41 and is connected to the shaft 46 through a suitable opening in the wall of the pipeline 41 for rotating the blades 43, 44. Thus, when the motor 47 is energized, the blades 43, 44 rotate to pump the fluid in the pipeline 41 in the direction of the arrows R and the blades 43, 44 assume an angular equilibrium position as explained above.

Thus, the most efficient operation of the pumping apparatus 42 of FIG. 4 is obtained irrespective of the resistance in the line 41 due to the self-adjusting feature of the blades 43, 44 and any possible damage to the blades 43, 44 which might occur by the sudden stopping of motor 47 is obviated since the blades simply move to the folded position to produce a minimum resistance to the flow of liquid within the pipeline 41.

Figure 5:
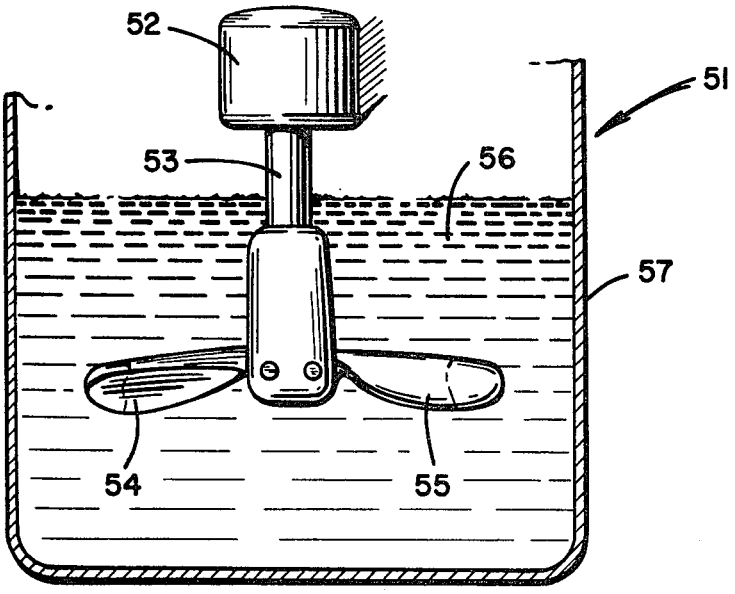
FIG. 5 is an elevation view of a mixing device representing still another embodiment of the invention.

FIG. 5 shows still another embodiment of the invention wherein a mixer or stirrer 51 is shown diagrammatically. The mixer 51 preferably includes a motor 52 having a shaft 53 to which blades 54, 55 constructed in accordance in the invention are attached as described above. The blades 54, 55 are immersed in the fluid material 56 to be stirred or mixed, the material being contained in a suitable container 57. As the blades 54, 55, during rotation of the shaft 53, assume the equilibrium angular position as described above with respect to the other embodiments, the mixer of FIG. 5 therefore operates with maximum efficiency in the mixing operation.

Figure 6D:
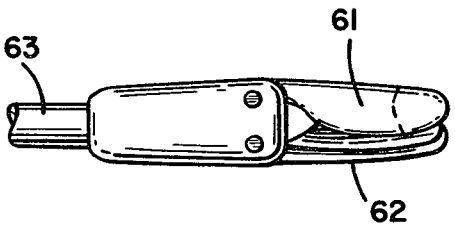
FIG. 6*d* is a view similar to FIG. 6*a* showing the blades in a folded position.
Figure 6C:
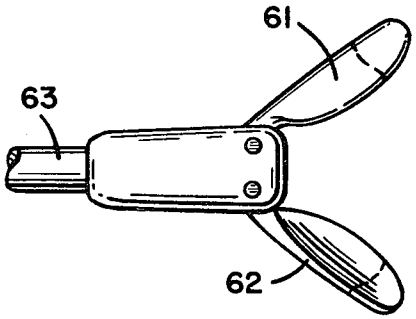
FIG. 6*c* is a view similar to FIG. 6*a* illustrating the blades in still another operating position.
Figure 6B:
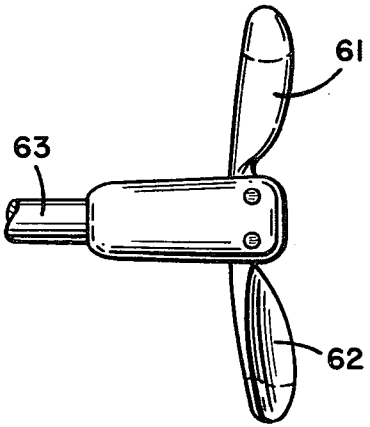
FIG. 6*b* is a view similar to FIG. 6*a* showing the blades in another position.
Figure 6A:
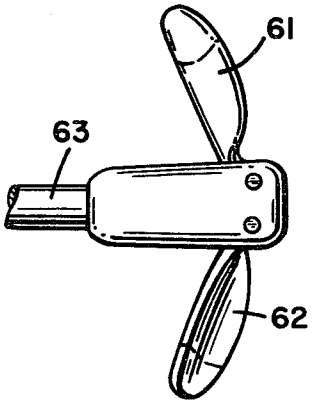
FIG. 6*a* is a view similar to FIG. 1 of still another embodiment of the invention showing the blades in one operating position.

FIGS. 6*a* through 6*d* relate to the application of the invention to a marine vehicle such as a boat wherein the blades 61, 62 mounted on a shaft 63 are utilized for propulsion as described in the aforementioned pending patent application. More specifically, in the self-adjusting feature of the blades 61, 62, the blades assume the position of FIG. 6*a* during the forward motion of the boat and the position of FIG. 6*c* during the rearward motion of the boat with which the blade arrangement of the invention is incorporated. FIG. 6*d* represents the folded position of blades 61, 62 and FIG. 6*b* the blade position when only centrifugal force is exerted on the blades 61, 62.

Obviously such propellers could also be used for obtaining a rotation of the propeller shaft by means of a stream of fluid, whereby the same advantages are obtained.

We claim:

1. Fluid pumping apparatus comprising, in combination a shaft, means for rotating said shaft, and blade means for pumping fluid in a direction substantially parallel to the axis of said shaft independent of the hydrodynamic forces of said fluid, said blade means comprising a pair of blades adapted to be fully submerged in the fluid to be pumped and wherein said blades are adapted to assume a folded position extending rearwardly from said shaft and substantially parallel to the shaft axis, means for pivotally mounting said blades at their inner ends on said shaft for immersion within the fluid to be pumped, said blades being freely pivotal during the rotation of said shaft into an equilibrium angular position throughout an angular range extending in both directions from a 90° position and in a common axial plane with respect to the axis of said shaft to thereby balance the centrifugal and hydrodynamic forces exerted on said blades during the pumping of the fluid so that the blades freely assume a position depending on the centrifugal and hydrodynamic forces exerted thereon to pump the fluid in a direction substantially parallel to the shaft axis.

2. Apparatus in accordance with claim 1 wherein said means for mounting said blades include means for interconnecting the inner ends of said blades for simultaneous pivotal movement of said blades in the same direction and into the same angular position with respect to the axis of said shaft.

3. Apparatus in accordance with claim 1 including stop means on said shaft for limiting the pivotal movement of said blades to a selected angular position forwardly of said 90° position.

4. Apparatus in accordance with claim 3 wherein said mounting means comprise a boss on said shaft having a diametral slot and including means for pivotally mounting the inner end of said blades on said boss within said slot and wherein said stop means comprises a bottom wall in said slot for limiting the forward pivotal movement of said blades to an obtuse angle with respect to the axis of said shaft.

5. The apparatus of claim 3 wherein said blades are pivotally movable to a position of 110° to 130° with respect to the axis of the shaft.

6. The apparatus of claim 4 wherein said obtuse angle is from 110° to 130°.

7. The apparatus of claim 5 wherein said means for pivotally mounting comprise a pair of pins mounted in said slot substantially parallel to each other and lying in a plane substantially perpendicular to the axis of said shaft, and means for mounting said blades on said pins for free rotation about the axis of said pins.

8. The apparatus of claim 7 wherein said means for pivotally mounting further comprise means for interconnecting the inner ends of said blades for simultaneous pivotal movement of said blades in the same direction and into the same angular position with respect to the axis of the shaft, said means for interconnecting comprise gear wheel segments on each inner end of said blades for interengagement with each other.

* * * * *